US008922581B2

(12) United States Patent
Kim et al.

(10) Patent No.: US 8,922,581 B2
(45) Date of Patent: Dec. 30, 2014

(54) DATA PROCESSING DEVICE, DISPLAY SYSTEM INCLUDING THE SAME AND METHOD OF PROCESSING DATA

(75) Inventors: Yun-Jae Kim, Asan-si (KR); Junghwan Cho, Goyang-si (KR); Byoungjun Lee, Cheonan-si (KR); Nam-Hee Goo, Gunsan-si (KR); Myoung-Chul Kim, Dongducheon-si (KR); Bo-Ram Kim, Asan-si (KR)

(73) Assignee: Samsung Display Co., Ltd. (KR)

( * ) Notice: Subject to any disclaimer, the term of this patent is extended or adjusted under 35 U.S.C. 154(b) by 613 days.

(21) Appl. No.: 12/783,940

(22) Filed: May 20, 2010

(65) Prior Publication Data

US 2011/0057950 A1 Mar. 10, 2011

(30) Foreign Application Priority Data

Sep. 7, 2009 (KR) ..... 10-2009-0084031

(51) Int. Cl.
*G09G 5/02* (2006.01)
*G09G 5/04* (2006.01)

(52) U.S. Cl.
CPC .. *G09G 5/02* (2013.01); *G09G 5/04* (2013.01); *G09G 2300/0452* (2013.01); *G09G 2320/0276* (2013.01); *G09G 2340/0457* (2013.01); *G09G 2340/06* (2013.01)
USPC ..... 345/602; 345/600; 345/204; 345/581

(58) Field of Classification Search
None
See application file for complete search history.

(56) References Cited

U.S. PATENT DOCUMENTS 6,342,896 B1 * 1/2002 Shetter et al. ..... 345/589
7,705,810 B2 * 4/2010 Choi et al. ..... 345/77
7,782,335 B2 * 8/2010 Baek ..... 345/586
8,018,476 B2 * 9/2011 Credelle et al. ..... 345/690
8,035,655 B2 * 10/2011 Kim et al. ..... 345/604
2004/0051724 A1 * 3/2004 Elliott et al. ..... 345/694
2008/0252797 A1 * 10/2008 Hamer et al. ..... 348/802

FOREIGN PATENT DOCUMENTS

JP 2008026339 2/2008
KR 1020060062912 6/2006
KR 1020070011830 1/2007

OTHER PUBLICATIONS

Hung, et al "Manipulation image processing algorithmic technology to realize 1.8" RGBW transflective TFT-LCDs with adjustable color gamut", Displays, 29(5), pp. 526-535, Dec. 2008.*
Brown-Elliott, et al "Adding a White Subpixel", Information Display, pp. 26-31, May 2005.*

* cited by examiner

*Primary Examiner* — Ulka Chauhan
*Assistant Examiner* — Patrick F Valdez
(74) *Attorney, Agent, or Firm* — Cantor Colburn LLP

(57) ABSTRACT

A data processing device includes a receiving module, a rendering module and a color compensation module. The rendering module receives image data from the receiving module and renders the image data into first, second, third and fourth sub-pixel data based on a layout of a first sub-pixel, a second sub-pixel, a third sub-pixel and a fourth sub-pixel and the color compensation module compensates for a color of the first, second and third sub-pixel data. The color compensation module converts the first, second and third sub-pixel data into first, second and third intermediate data, respectively, adds first, second and third delta values, which are determined based on the fourth sub-pixel data, to the first, second and third intermediate data, and thereby generates first, second and third compensation data.

20 Claims, 13 Drawing Sheets

R-LUT

| Ri | Ro |
|---|---|
| 0 | 0 |
| 1 | 1.5 |
| 2 | 2.5 |
| 3 | 4 |
| ⋮ | ⋮ |
| 253 | 49 |
| 254 | 50 |
| 255 | 51 |

G-LUT

| Gi | Go |
|---|---|
| 0 | 0 |
| 1 | 1 |
| 2 | 2 |
| 3 | 3 |
| ⋮ | ⋮ |
| 253 | 174 |
| 254 | 177 |
| 255 | 179 |

B-LUT

| Bi | Bo |
|---|---|
| 0 | 0 |
| 1 | 0.5 |
| 2 | 1.5 |
| 3 | 2 |
| ⋮ | ⋮ |
| 253 | 24 |
| 254 | 24.5 |
| 255 | 25 |

Fig. 5

W-LUT

| Wi | Wo | ΔRo | ΔGo | ΔBo |
|---|---|---|---|---|
| 0 | 0 | 0 | 0 | 0 |
| 1 | 1 | +0.5 | 0 | 0 |
| 2 | 2.0 | +0.7 | 0 | -1.2 |
| 3 | 3.5 | +0.9 | -0.1 | -1.3 |
| ⋮ | ⋮ | ⋮ | ⋮ | ⋮ |
| 253 | 152 | +3 | -0.1 | -5 |
| 254 | 153 | +2 | 0 | -3 |
| 255 | 155 | 0 | 0 | 0 |

B2

| | | |
|---|---|---|
| | $G1c=G1o+\frac{\Delta Go}{2}$ | |
| $Bc=Bo+\Delta Bo$ | $Wc=Wo$ | $Rc=Ro+\Delta Ro$ |
| | $G2c=G2o+\frac{\Delta Go}{2}$ | |

B3

| | | |
|---|---|---|
| $R1c=R1o+\frac{\Delta Ro}{3}$ | $G1c=G1o+\frac{\Delta Go}{2}$ | $B1c=B1o+\frac{\Delta Bo}{3}$ |
| $B2c=B2o+\frac{\Delta Bo}{3}$ | $Wc=Wo$ | $R2c=R2o+\frac{\Delta Ro}{3}$ |
| $R3c=R3o+\frac{\Delta Ro}{3}$ | $G2c=G2o+\frac{\Delta Go}{2}$ | $B3c=B3o+\frac{\Delta Bo}{3}$ |

DATA PROCESSING DEVICE, DISPLAY SYSTEM INCLUDING THE SAME AND METHOD OF PROCESSING DATA

This application claims priority to Korean Patent Application No. 2009-84031, filed on Sep. 7, 2009, and all the benefits accruing therefrom under 35 U.S.C. §119, the content of which in its entirety is herein incorporated by reference.

BACKGROUND OF THE INVENTION (1) Field of the Invention

The present invention relates to a data processing device, a display system including the data processing device and a method of processing data. More particularly, the present invention relates to a data processing device including a color compensation function, a display system including the data processing device and a method of processing data.

(2) Description of the Related Art

A pixel of a display apparatus typically includes sub-pixels which display red, green and blue colors, to display an image. Recently, a pixel structure including a red sub-pixel R, a green sub-pixel G, a blue sub-pixel B, as well as a white sub-pixel W, has been suggested to improve brightness of the display apparatus. Moreover, to improve an aperture ratio and transmittance, six sub-pixels, e.g., RGBRGB sub-pixels, of a conventional pixel design may be replaced with four sub-pixels, e.g., RGBW sub-pixels, (hereinafter, referred to as "PENTILE® technology").

A display apparatus employing the PENTILE® technology includes a rendering module that renders RGB image data to RGBW sub-pixel data to compensate for a lowered resolution thereof, which is caused by a reduced number of sub-pixels, e.g. from RGBRGB to RGBW.

BRIEF SUMMARY OF THE INVENTION

An aspect of present invention relates to a data processing device which performs color compensation for rendered data.

An aspect of the present invention also relates to a display system including the data processing device.

An aspect of the present invention also relates to a method of processing data which compensates for rendered data In an exemplary embodiment, a data processing device processes image data and provides the image data to a display apparatus including pixels, each including a first sub-pixel, a second sub-pixel, a third sub-pixel and a fourth sub-pixel, which have difference colors from each other. The data processing device includes a receiving module, a rendering module and a color compensation module.

The receiving module receives the image data, the rendering module renders the image data into first sub-pixel data, second sub-pixel data, third sub-pixel data and fourth sub-pixel data based on a layout of the first sub-pixel, the second sub-pixel, the third sub-pixel and the fourth sub-pixel and the color compensation module compensates for a color of the first sub-pixel, the second sub-pixel, the third sub-pixel and the fourth sub-pixel data.

The color compensation module includes a first compensation block and a second compensation block. The first compensation block converts the first sub-pixel data, the second sub-pixel data and the third sub-pixel data corresponding to the first sub-pixel, the second sub-pixel and the third sub-pixel, respectively, included in a reference block set based on the fourth sub-pixel, into first intermediate data, second intermediate data and third intermediate data, respectively, based on a gamma compensation value. The second compensation block converts the fourth sub-pixel data, corresponding to the fourth sub-pixel, into fourth compensation data based on the gamma compensation value, and converts the first intermediate data, the second intermediate data and the third intermediate data into first compensation data, second compensation data and third compensation data based on a first delta value, a second delta value and a third delta value, respectively, which are determined based on the fourth sub-pixel data.

In an exemplary embodiment, a display system includes an image source which outputs image data, a display apparatus which includes pixels and displays an image, and a data processing device which processes the image data and provides processed image data to the display apparatus. Each of the pixel includes a first sub-pixel, a second sub-pixel, a third sub-pixel and a fourth sub-pixel which have difference colors from each other.

The data processing device includes a receiving module which receives the image data from the image source, a rendering module which renders the image data into first sub-pixel data, second sub-pixel data, third sub-pixel data and fourth sub-pixel data based on a layout of the first sub-pixel, the second sub-pixel, the third sub-pixel, and the fourth sub-pixel and a color compensation module which compensates for a color of the first sub-pixel data, the second sub-pixel data, the third sub-pixel data and the fourth sub-pixel data.

The color compensation module includes a first compensation block and a second compensation block. The first compensation block converts the first sub-pixel data, the second sub-pixel data and the third sub-pixel data corresponding to the first sub-pixel, the second sub-pixel and the third sub-pixel, respectively, included in a reference block set based on the fourth sub-pixel, into first intermediate data, second intermediate data and third intermediate data, respectively, based on a gamma compensation value. The second compensation block converts the fourth sub-pixel data corresponding to the fourth sub-pixel into fourth compensation data based on the gamma compensation value and converts the first intermediate data, the second intermediate data and the third intermediate data into first compensation data, second compensation data and third compensation data, respectively, based on a first delta value, a second delta value and a third delta value which are determined based on the fourth sub-pixel data.

In an exemplary embodiment, a method of processing image data provided to a display apparatus including pixels, each including a first sub-pixel, a second sub-pixel, a third sub-pixel and a fourth sub-pixel which have difference colors from each other includes receiving the image data, rendering the image data into first sub-pixel data, second sub-pixel data, third sub-pixel data and fourth sub-pixel data based on a layout of the first sub-pixel, the second sub-pixel, the third sub-pixel and the fourth sub-pixel and compensating for a color of the first sub-pixel data, the second sub-pixel data, the third sub-pixel data and the fourth sub-pixel data.

The compensating for the color includes converting the first sub-pixel data, the second sub-pixel data and the third sub-pixel data corresponding to the first sub-pixel, the second sub-pixel and the third sub-pixel, respectively, included in a reference block set based on the fourth sub-pixel into first intermediate data, second intermediate data and third intermediate data, respectively, based on a gamma compensation value, converting the fourth sub-pixel data corresponding to the fourth sub-pixel into fourth compensation data based on the gamma compensation value, and converting the first intermediate data, the second intermediate data and the third intermediate data into first compensation data, second compensation data and third compensation data based on a first delta value, a second delta value and a third delta value, respectively, which are determined based on the fourth sub-pixel data.

In an exemplary embodiment, the first sub-pixel data, the second sub-pixel data and the third sub-pixel data may be compensated by adding the first delta value, the second delta value and the third delta value which are determined based on a gray scale value of the fourth sub-pixel data into the first compensation data, the second compensation data and the third compensation data. Thus, colors are substantially accurately compensated, and the display apparatus including a PENTILE® pixel structure including red, green, blue and white sub-pixels thereby displays colors substantially accurately.

BRIEF DESCRIPTION OF THE DRAWINGS

The above and other aspects and features of the present invention will become more readily apparent by describing in further detail exemplary embodiments thereof with reference to the accompanying drawings, in which:

FIG. 5 is a plan view of an exemplary embodiment of a white look-up table according to the present invention;

DETAILED DESCRIPTION OF THE INVENTION

Figure 1:
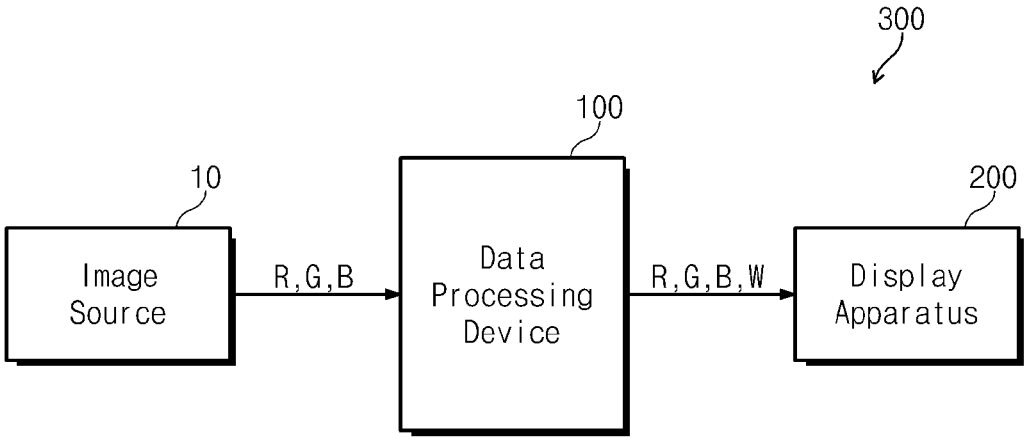
FIG. 1 is a block diagram showing an exemplary embodiment of a display system according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout. It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

FIG. 1 is a block diagram of an exemplary embodiment of a display system according to the present invention.

As shown in FIG. 1, a display system 300 includes an image source 10 that outputs image data, e.g., red, green and blue image data R, G and B, respectively, a data processing device 100 which renders the image data, e.g., the red, green and blue image data R, G and B, respectively, and a display apparatus 200 which displays an image using the image data rendered by the data processing device 100, e.g., red, green, blue and white image data R, G, B and W, respectively.

The image source 10 outputs the image data including red, green and blue image data R, G and B, respectively. The image source 10 may be various electric appliances such as a personal computer, a television set, a video player, a digital cellular phone and other similar devices, but alternative exemplary embodiments are not limited thereto or thereby.

The image data, e.g., the red, green and blue image data R, G and B, outputted from the image source 10 are provided to the data processing device 100. The data processing device 100 renders the images data, e.g., the red, green and blue image data R, G and B, and supplies the rendered data, e.g., the red, green, blue and white image data R, G, B and W, to the display apparatus 200. The rendered data, e.g., the red, green, blue and white image data R, G, B and W, may be red, green, blue and white sub-pixel data.

The display apparatus 200 includes pixels, each including red, green, blue and white sub-pixels. Particularly, the data processing device 100 renders the image data, e.g., the red, green and blue image data R, G and B based on a layout of the sub-pixels. Accordingly, the display apparatus 200 may display the image using the rendered data, e.g., the red, green, blue and white image data R, G, B and W. The display apparatus 200 may be a flat-type display apparatus including a liquid crystal display such as a television set, a monitor or a cellular phone, for example.

As shown in FIG. 1, the data processing device 100 may be a separate card or board, and thus the data processing device 100 may be disposed between the image source 10 and the display apparatus 200 or disposed in a device or an unit connected between the image source 10 and the display apparatus 200, but it should not be limited thereto or thereby. In another exemplary embodiment, the data processing device 100 may be disposed in a timing controller (not shown) of the display apparatus 200.

Figure 2:
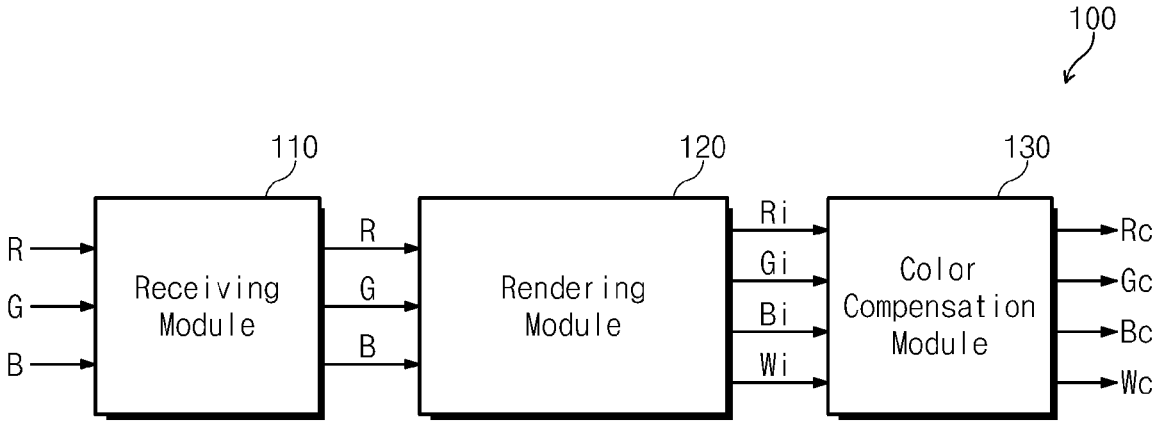
FIG. 2 is a block diagram of a data processing device of the display system of FIG. 1.

FIG. 2 is a block diagram of an exemplary embodiment of a data processing device of the display system of FIG. 1.

As shown in FIG. 2, the data processing device 100 includes a receiving module 110, a rendering module 120 and a color compensation module 130.

The receiving module 110 receives the image data, e.g., the red, green and blue image data R, G and B, from the image source 10 shown in FIG. 1 and provides the image data R, G and B to the rendering module 120.

The rendering module 120 renders the image data, e.g., the red, green and blue image data R, G and B, received from the receiving module 110, to sub-pixel data, e.g., red, green, blue and white sub-pixel data Ri, Gi, Bi and Wi, based on the layout of the sub-pixels in the display apparatus 200. In an exemplary embodiment, when each of the pixels of the display apparatus 200 includes red, green, blue and white sub-pixels, the rendering module 120 renders the red, green and blue image data R, G and B to the red, green, blue and white sub-pixel data Ri, Gi, Bi and Wi.

The rendering process by the rendering module 120 will be described in further detail below with reference to FIGS. 9 to 11C.

The color compensation module 130 compensates for colors of the sub-pixel data, e.g., the red, green, blue and white sub-pixel data Ri, Gi, Bi and Wi, and outputs compensation data, e.g., red, green, blue and white compensation data Rc, Gc, Bc and Wc. Particularly, the color compensation module 130 gamma-compensates the sub-pixel data, e.g., the red, green, blue and white sub-pixel data Ri, Gi, Bi and Wi, based on a gamma compensation value set by a gamma characteristic of the display apparatus 200 and outputs the compensation data, e.g., the red, green, blue and white compensation data Rc, Gc, Bc and Wc. In an exemplary embodiment, the compensation data, e.g., the red, green, blue and white compensation data Rc, Gc, Bc and Wc, may have bit numbers expanded more than bit numbers of the sub-pixel data, e.g., the red, green, blue and white sub-pixel data Ri, Gi, Bi and Wi. Thus, the color compensation module 130 may effectively prevent a color coordinate value from varying depending on gray scales, and thereby improves color characteristics of the display apparatus 200.

Figures 3, 4:
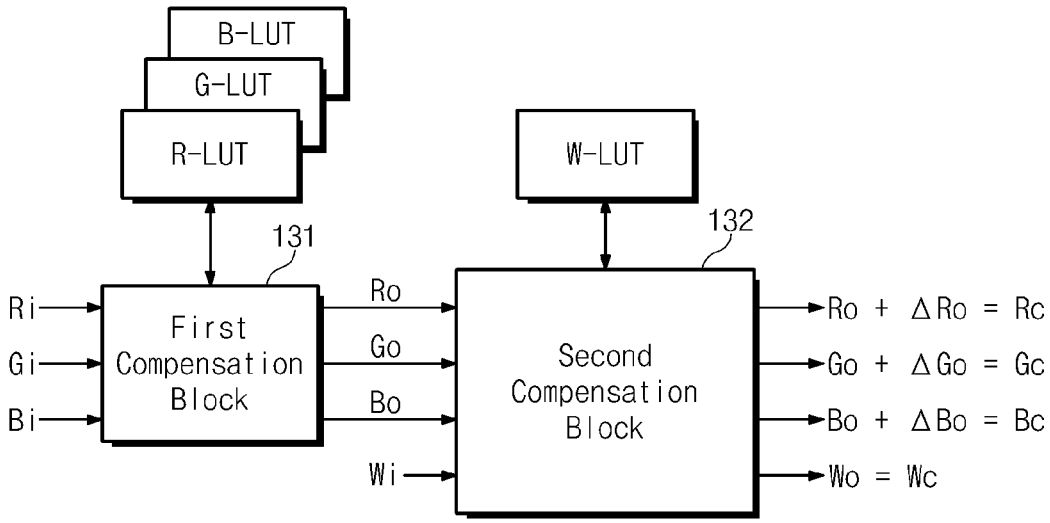
FIG. 3 is a block diagram of a color compensation module of the data processing device of FIG. 2.
FIG. 4 is a plan view of a red look-up table, a green look-up table and a blue look-up table of the color compensation module of FIG. 3.

FIG. 3 is a block diagram of an exemplary embodiment of a color compensation module of FIG. 2, FIG. 4 is a plan view of a red look-up table, a green look-up table and a blue look-up table of FIG. 3, and FIG. 5 is a plan view of a white look-up table.

As shown in FIG. 3, the color compensation module 130 includes a first compensation block 131 and a second compensation block 132.

The first compensation block 131 receives the red, green and blue sub-pixel data Ri, Gi and Bi and converts the red, green and blue sub-pixel data Ri, Gi and Bi into red, green and blue intermediate data Ro, Go and Bo, respectively, based on red, green and blue gamma compensation values set by red, green and blue gamma characteristics.

The red, green and blue sub-pixel data Ri, Gi and Bi provided to the first compensation block 131 may be the red, green and blue sub-pixel data Ri, Gi and Bi corresponding to the red, green and blue sub-pixels, respectively, included in a reference block determined with reference to the white sub-pixel. The reference block will be described later in more detail with reference to FIGS. 6A to 8A and 6B to 8B.

The second compensation block 132 converts white sub-pixel data Wi corresponding to the white sub-pixel to white compensation data Wo based on a predetermined white gamma compensation value, e.g., Wo=Wi. In addition, the second compensation block 132 converts the red, green and blue intermediate data Ro, Go and Bo into red, green and blue compensation data Rc, Gc and Bc, respectively, based on the white sub-pixel data Wi.

Referring now to FIGS. 3 to 5, the color compensation module 130 further includes red, green, blue and white look-up table R-LUT, G-LUT, B-LUT and W-LUT.

As shown in FIG. 4, the red, green and blue look-up table R-LUT, G-LUT and B-LUT store the red, green and blue intermediate data Ro, Go and Bo, respectively, according to gray scale values of the red, green and blue sub-pixel data Ri, Gi and Bi. Accordingly, the first compensation block 131 may generate the red, green and blue intermediate data Ro, Go and Bo with reference to the red, green and blue look-up table R-LUT, G-LUT and B-LUT.

Referring to FIG. 5, the white look-up table W-LUT stores the white compensation data Wo therein according to the gray scale value of the white sub-pixel data Wi. In addition, the white look-up table W-LUT further stores red, green and blue delta values ΔRo, ΔGo and ΔBo set according to the gray scale value of the white sub-pixel data Wi. In an exemplary embodiment, the red delta value ΔRo may be zero or a positive constant number, and the green and blue delta values ΔGo and ΔBo may be zero or a negative constant number.

Accordingly, the second compensation block 132 may generate the white compensation data Wo and the red, green and blue compensation data Rc, Gc and Bc with reference to the white look-up table W-LUT.

More particularly, the second compensation block 132 adds the red, green and blue delta values ΔRo, ΔGo and ΔBo to the red, green and blue intermediate data Ro, Go and Bo, respectively, according to the white compensation data Wo and thereby generates the red, green and blue compensation data Rc, Gc and Bc.

Thus, the compensation value of each of the red, green and blue sub-pixel data Ri, Gi and Bi may be increased or decreased according to the gray scale value of the white sub-pixel data Wi. In an exemplary embodiment, when the red, green and blue compensation data Rc, Gc and Bc are generated based on the gray scale values of the red, green and blue sub-pixel data Ri, Gi and Bi and the gray scale value of the white sub-pixel data Wi, the colors are substantially accurately compensated, and the color coordinates of the red, green, blue and white sub-pixels are substantially uniformly maintained with respect to all gray scale levels.

Figure 6A:
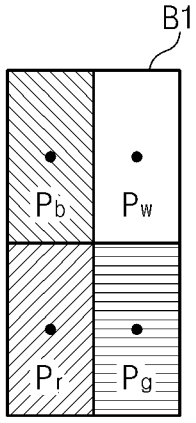
FIG. 6A is a plan view of an exemplary embodiment of a reference block according to the present invention.
Figure 6B:
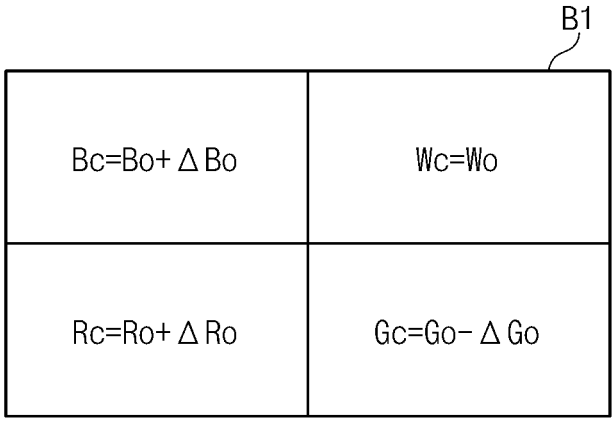
FIG. 6B is a plan view of an exemplary embodiment of compensation data provided to the reference block of FIG. 6A.

FIG. 6A is a plan view of an exemplary embodiment of a reference block, and FIG. 6B is a plan view showing an exemplary embodiment of compensation data provided to the reference block of FIG. 6A. The reference block is provided to define the sub-pixel data provided to the second compensation block 132.

Referring to FIGS. 6A and 6B, a reference block B1 may be a pixel including a white sub-pixel Pw. In an exemplary embodiment, the reference block B1 includes white, red, green and blue sub-pixels Pw, Pr, Pg and Pb.

The second compensation block 132 adds the red, green and blue delta values ΔRo, ΔGo and ΔBo respectively to the red, green and blue intermediate data Ro, Go and Bo corresponding to the red, green and blue sub-pixels Pr, Pg and Pb, respectively, included in the reference block B1 and thereby generates the red, green and blue compensation data Rc, Gc and Bc.

In an exemplary embodiment, the reference block B1 includes one red sub-pixel Pr, one green sub-pixel Pg and one blue sub-pixel Pb, but it should not be limited thereto or thereby. In another exemplary embodiment, the numbers of the red, green and blue sub-pixels Pr, Pg and Pb included in the reference block B1 may vary based on design of the reference block B1. Accordingly, the delta value added to each of the red, green and blue intermediate data Ro, Go and Bo may vary based on the numbers of red, green and blue sub-pixels Pr, Pg and Pb included in the reference block B1.

In an exemplary embodiment, the second compensation block 132 divides the red delta value ΔRo by the number (n1) of the red sub-pixels Pr in the reference block B1 to generate a result value of "ΔRo/n1", and adds the result value of ΔRo/n1 to the red intermediate data Ro of each of the red sub-pixels Pr, and thereby generates the red compensation data Rc. The second compensation block 132 divides the green delta value ΔGo by the number (n2) of the green sub-pixels Pg in the reference block B1 to generate a result value of "ΔGo/n2", and adds the result value of ΔGo/n2 to the green intermediate data Go of each of the green sub-pixels Pg, and thereby generates the green compensation data Gc. Similarly, the second compensation block 132 divides the blue delta value ΔBo by the number (n3) of the blue sub-pixels Pb in the reference block B1 to generates a result value of "ΔBo/n3", and adds the result value of ΔBo/n3 to the blue intermediate data Bo of each of the blue sub-pixels Pb, and thereby generates the blue compensation data Bc.

Referring again to FIG. 6A, since the reference block B1 includes one red sub-pixel Pr, one green sub-pixel Pg, and one blue sub-pixel Pb, the number (n1) of the red sub-pixels Pr, the number (n2) of the green sub-pixels Pg, and the number (n3) of the blue sub-pixels Pb have the same value of "1" (e.g., n1=n2=n3=1). Accordingly, each of the red, green and blue compensation data Rc, Gc and Bc may be obtained by adding the red, green and blue delta value ΔRo, ΔGo and ΔBo to the red, green and blue intermediate data Ro, Go and Bo, respectively.

Figures 7A, 7B:
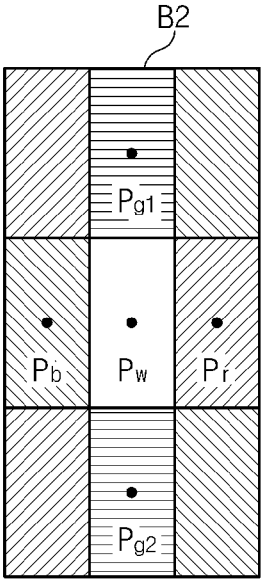
FIG. 7A is a plan view of another exemplary embodiment of a reference block according to the present invention.
FIG. 7B is a plan view of an exemplary embodiment of compensation data provided to the reference block of FIG. 7A.

FIG. 7A is a plan view of another exemplary embodiment of a reference block, and FIG. 7B is a plan view of compensation data provided to the reference block of FIG. 7A.

Referring to FIGS. 7A and 7B, a reference block B2 includes the white sub-pixel Pw and four sub-pixels disposed adjacent to four sides of the white sub-pixel Pw, respectively. In an exemplary embodiment, the four sub-pixels includes a blue sub-pixel Pb disposed adjacent to a first side of the white sub-pixel Pw, a red sub-pixel Pr disposed adjacent to a second side opposite to the first side, a first green sub-pixel Pg1 disposed adjacent to a third side of the white sub-pixel Pw and a second green sub-pixel Pg2 disposed adjacent to fourth side opposite to the third side.

As shown in FIG. 7A, the reference block B2 includes one red sub-pixel Pr, one blue sub-pixel Pb and two green sub-pixels, e.g., a first green sub-pixel Pg1 and a second green sub-pixel Pg2.

In an exemplary embodiment, the second compensation block 132 adds the red delta value ΔRo to the red intermediate data Ro corresponding to the red sub-pixel Pr to generate the red compensation data Rc, and adds the blue delta value ΔBo to the blue intermediate data Bo corresponding to the blue sub-pixel Pb to generate the blue compensation data Bc.

As shown in FIG. 7B, when the reference block B2 includes the two green sub-pixels, e.g., the first green sub-pixel Pg1 and the second green sub-pixel Pg2, the second compensation block 132 adds a value of "ΔGo/2" to a first green intermediate data G1*o* corresponding to the first green sub-pixel Pg1 to generate a first green compensation data G1*c*, and adds the value of "ΔGo/2" to a second green intermediate data G2*o* corresponding to the second green sub-pixel Pg2 to generate a second green compensation data G2*c*.

Figures 8A, 8B:
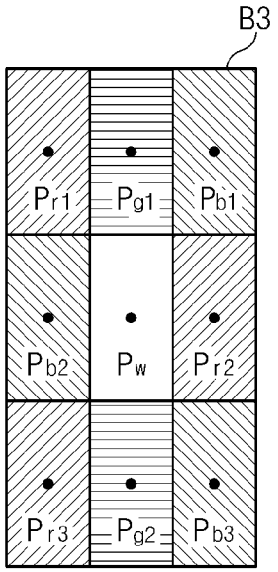
FIG. 8A is a plan view of another exemplary embodiment of a reference block according to the present invention.
FIG. 8B is a plan view of an exemplary embodiment of compensation data provided to the reference block of FIG. 8A.

FIG. 8A is a plan view of another exemplary embodiment of a reference block, and FIG. 8B is a plan view of compensation data provided to the reference block of FIG. 8A.

As shown in FIG. 8A, a reference block B3 includes the white sub-pixel Pw and eight sub-pixels disposed adjacent to the white sub-pixel Pw. In an exemplary embodiment, the eight sub-pixels include first, second and third red sub-pixels Pr1, Pr2 and Pr3, first, second and third blue sub-pixels Pb1, Pb2 and Pb3 and first and second green sub-pixels Pg1 and Pg2.

As shown in FIG. 8B, the second compensation block 132 adds a value of "ΔRo/3" to first, second and third red intermediate data R1*o*, R2*o* and R3*o* corresponding to the first, second and third red sub-pixels Pr1, Pr2 and Pr3, respectively, to generate first, second and third red compensation data R1*c*, R2*c* and R3*c*. The second compensation block 132 adds a value of "ΔBo/3" to first, second and third blue intermediate data B1*o*, B2*o* and B3*o* corresponding to the first, second and third blue sub-pixels Pb1, Pb2 and Pb3, respectively, to generate first, second and third blue compensation data B1*c*, B2*c* and B3*c*. Similarly, the second compensation block 132 adds a value of "ΔGo/2" to first and second green intermediate data G1*o* and G2*o* corresponding to the first and second green sub-pixels Pg1 and Pg2, respectively, to generate first and second green compensation data G1*c* and G2*c*.

In another exemplary embodiment, the reference blocks B1, B2 and B3 may include various structures aside from the structures shown in FIGS. 6A, 7A and 8A, and the delta values depends on the numbers of the red, green and blue sub-pixels included in the reference blocks B1, B2 and B3.

Figure 9:
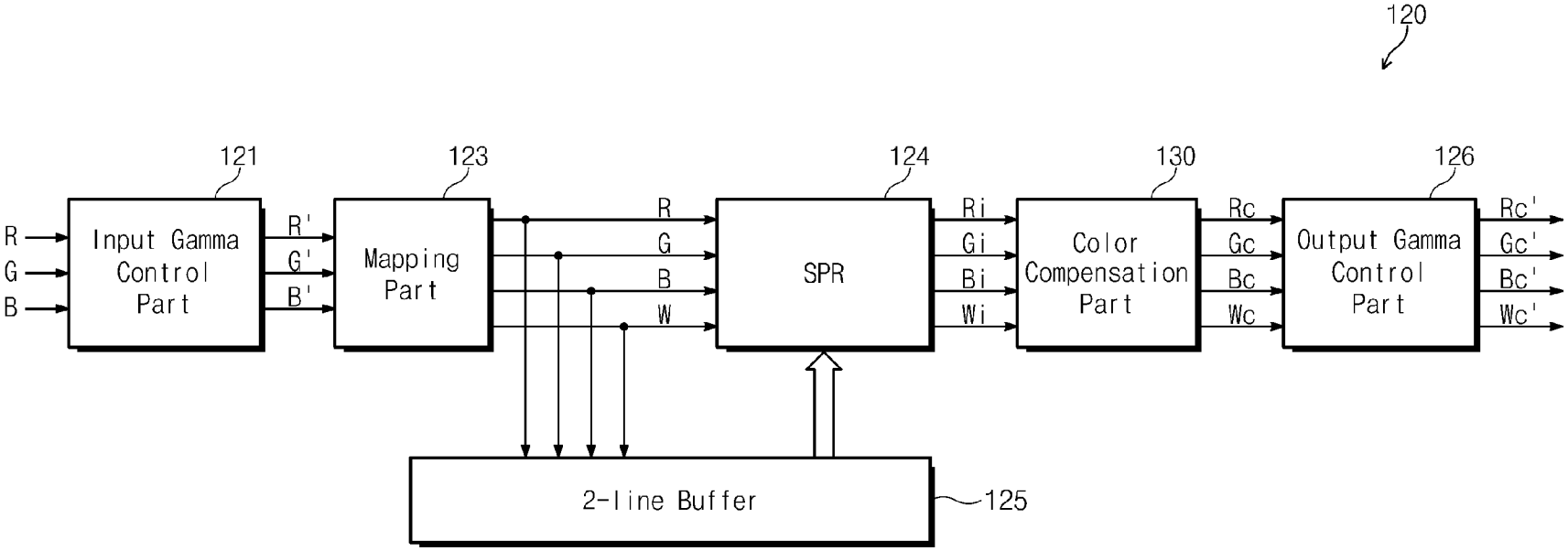
FIG. 9 is a block diagram of an exemplary embodiment of a rendering module of the data processing device of FIG. 2.

FIG. 9 is a block diagram of another exemplary embodiment of a rendering module of FIG. 2. The rendering module of FIG. 9 includes a color compensation module 130 (hereinafter, referred to as a "color compensation part").

As shown in FIG. 9, the rendering module 120 includes an input gamma control part 121, a mapping part 123, a sub-pixel rendering part 124 (hereinafter, referred to as "SPR"), a 2-line buffer 125, a color compensation module 130 and an output gamma control part 126.

The input gamma control part 121 applies a gamma function to the image data, e.g., the red, green and blue image data R, G and B, received from the receiving module 110 shown in FIG. 2 to linearize the image data, e.g., the red, green and blue image data R, G and B. In an exemplary embodiment, when the gamma function (e.g., $f=x^{2.2}$) that squares a reference gamma value (e.g., 2.2) is applied to the red, green and blue data R, G and B, the input gamma control part 121 outputs linearized red, green and blue data R', G' and B'.

In an exemplary embodiment, the input gamma control part 121 may linearize the image data due to difficulties in hardware embodiment when blocks, e.g. mapping part, SPR and other similar blocks, execute various calculation processes using the red, green and blue image data R, G and B, which are non-linear.

The mapping part 123 maps the linearized red, green and blue data R', G' and B' from the input gamma control part 121 to red, green, blue and white data R, G, B and W. In an exemplary embodiment, the mapping part 123 may map RGB gamut of the red, green and blue data to RGBW gamut of the red, green, blue and white data using a gamut mapping algorithm ("GMA"). In another exemplary embodiment, the gamut mapping process may be omitted from the mapping processes by the mapping part 123.

The 2-line buffer 125 stores the red, green, blue and white data R, G, B and W outputted from the mapping part 123. The SPR 124 receives the red, green, blue and white data R, G, B and W from the 2-line buffer 125 at a predetermined time point and starts the rendering operation. The SPR 124 includes an SPR filter, and thereby performs the rendering operation. In an exemplary embodiment, the SPR 124 renders the red, green, blue and white data R, G, B and W provided from the 2-line buffer 125 when the red, green, blue and white data R, G, B and W are passed through the SPR filter, and thereby generates the red, green, blue and white sub-pixel data Ri, Gi, Bi and Wi.

The rendering method used in the SPR 124 will be described in more detail later with reference to FIGS. 10A to 11C.

In an exemplary embodiment, the SPR 124 may further include a sharpening filter that filters the red, green, blue and white sub-pixel data Ri, Gi, Bi and Wi that have been rendered by the SPR filter to improve vividness of colors displayed on a display apparatus.

The color compensation module 130 compensates for the red, green, blue and white sub-pixel data Ri, Gi, Bi and Wi and thereby outputs red, green, blue and white compensation data Rc, Gc, Bc and Wc. A structure of the color compensation module 130 is substantially the same as the structure of the color compensation module 130 shown in FIGS. 2 and 3, and thus detailed description of the color compensation module 130 will be omitted.

The output gamma control part 126 applies a reverse gamma function to the red, green, blue and white compensation data Rc, Gc, Bc and Wc to non-linearize the red, green, blue and white compensation data Rc, Gc, Bc and Wc. In an exemplary embodiment, when the input gamma control part 121 linearizes the red, green and blue data R, G and B using the gamma function, "$f=x^{2.2}$", the output gamma control part 126 may non-linearize the red, green, blue and white compensation data Rc, Gc, Bc and Wc using a reverse gamma function, "$f=x^{1/2.2}$".

Non-linearized red, green, blue and white compensation data Rc', Gc', Bc' and Wc' by the output gamma control part 126 may be provided to the display apparatus 200.

The structure of the above-described rendering module 120 should not be limited thereto or thereby, and the rendering module 120 may further include function parts, e.g., a dithering function part, other than the parts shown in FIG. 9.

Figure 10A:
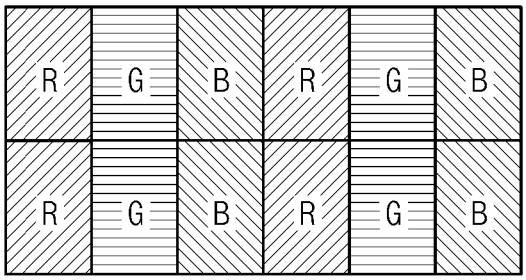
FIG. 10A is a plan view of a 3-pixel structure according to the present invention.
Figure 10B:
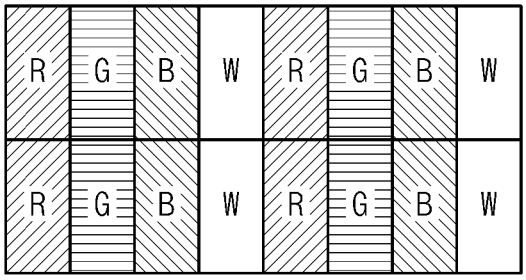
FIG. 10B is a plan view of a 4-pixel structure according to the present invention.
Figure 10C:
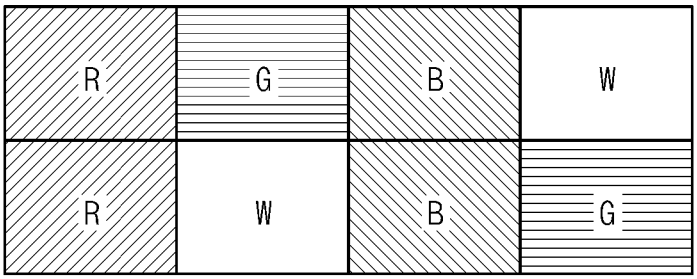
FIG. 10C is a plan view of a PENTILE® pixel structure according to the present invention.

FIG. 10A is a plan view of an exemplary embodiment of a 3-pixel structure, FIG. 10B is a plan view showing an exemplary embodiment of a 4-pixel structure, and FIG. 10C is a plan view showing an exemplary embodiment of a PENTILE® pixel structure. The 3-pixel structure is a structure in which one pixel includes red, green and blue sub-pixels, the 4-pixel structure is a structure in which one pixel includes red, green, blue and white sub-pixels, and the PENTILE® structure is a structure having a resolution obtained by reducing a resolution of the 4-pixel structure to a half.

Referring to FIGS. 9 and 10A, the red, green and blue data R, G and B input to the rendering module 120 correspond to the 3-pixel structure. Accordingly, the mapping part 123 of the rendering module 120 maps the red, green and blue data R, G and B to the red, green, blue and white data R, G, B and W. As a result, data corresponding to the 4-pixel structure are generated by the mapping part 123 as shown in FIG. 10B.

In the PENTILE® pixel structure of FIG. 10C, the resolution of the 4-pixel structure is reduced by half, and thereby improves an aperture ratio and transmittance of the display apparatus. The SPR 124 renders the red, green, blue and white data R, G, B and W to effectively prevent display quality from being lowered by the reduction of the resolution.

Figure 11A:
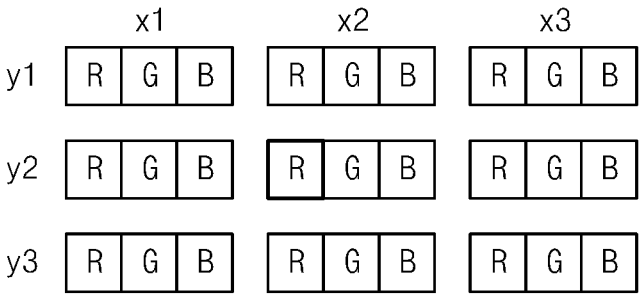
FIGS. 11A to 11C are plan views illustrating an exemplary embodiment of a mapping and rendering process according to the present invention.
Figure 11B:
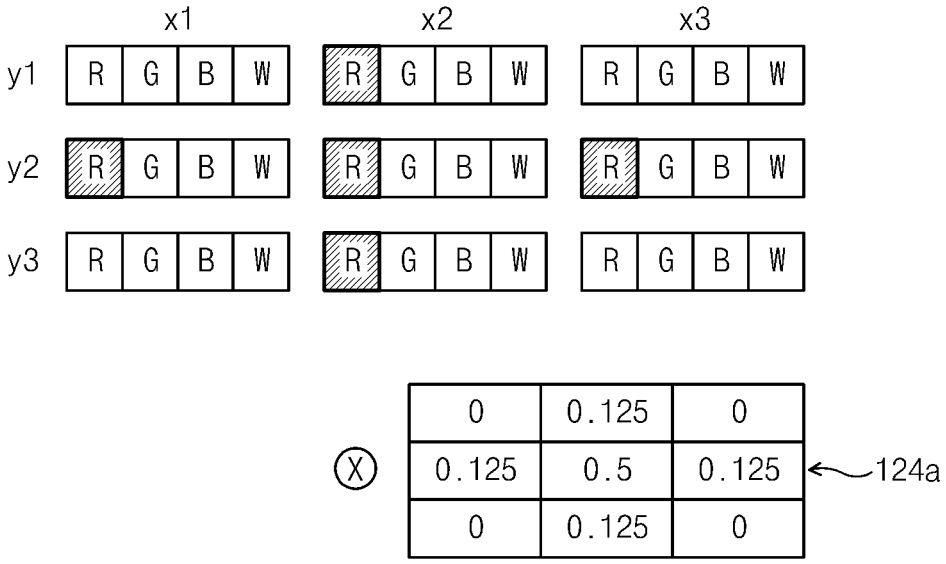
Figure 11C:
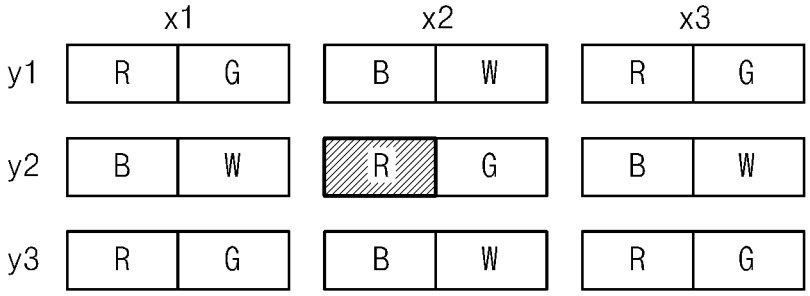

FIG. 11A to 11C are plan views of exemplary embodiments of a mapping and rendering process. FIG. 11A shows the 3-pixel structure, FIG. 11B shows the 4-pixel structure, and FIG. 11C shows the PENTILE® pixel structure. In FIG.

11A, an exemplary embodiment of nine pixels are shown when the SPR 124 employs a diamond filter that uses nine filters as an example.

Referring to FIGS. 9, 11A and 11B, the mapping part 123 maps the red, green and blue data R, G and B provided to the each of the pixels to the red, green, blue and white data R, G, B and W.

Referring to FIGS. 9, 11B and 11C, the red, green, blue and white data R, G, B and W output from the mapping part 123 are rendered by a diamond filter 124*a* included in the SPR 124. In an exemplary embodiment, when a reference red data R in the pixel corresponding to a coordinate of x2-y2 and eight red data R adjacent to the reference red data R pass through the diamond filter 124*a*, red sub-pixel data R corresponding to red sub-pixel of the PENTILE® pixel structure may be generated.

As shown in FIG. 11B, the diamond filter 124*a* includes scale coefficients corresponding to nine predetermined areas, respectively. The SPR 124 multiplies each of the reference red data and the eight red data by a corresponding scale coefficient of the scale coefficients, adds the multiplied values to one another and outputs the added value as a rendering value of the reference red data R. In an exemplary embodiment, the scale coefficients corresponding to the nine predetermined areas, respectively, are set so that a sum of the scale coefficients becomes approximately 1. Similarly, the green, blue and white data may be rendered.

In FIG. 11B, the diamond filter 124*a* is described as an example, so it should not be limited thereto or thereby. In another exemplary embodiment, various rendering filters may be used instead of the diamond filter 124*a*.

Figure 12:
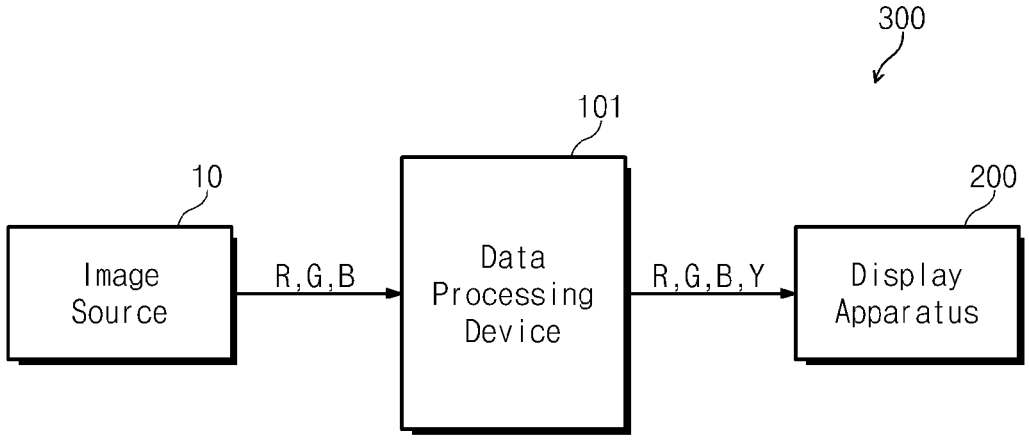
FIG. 12 is a block diagram of another exemplary embodiment of a display system according to the present invention.

FIG. 12 is a block diagram of another exemplary embodiment of a display system according to the present invention.

Referring to FIG. 12, a display system 300 includes an image source 10 that outputs image data, e.g., red, green and blue image data R, G and B, respectively, a data processing device 101 which renders the image data, e.g., the red, green and blue image data R, G and B, respectively, and a display apparatus 200 which displays an image using the image data rendered by the data processing device 101, e.g., red, green, blue and yellow image data R, G, B and Y, respectively.

The image source 10 outputs the image data including red, green and blue image data R, G and B, respectively. The image data, e.g., the red, green and blue image data R, G and B, outputted from the image source 10 are provided to the data processing device 101. The data processing device 101 renders the images data, e.g., the red, green and blue image data R, G and B, and supplies the rendered data, e.g., the red, green, blue and yellow image data R, G, B and Y, to the display apparatus 200. The rendered data, e.g., the red, green, blue and yellow image data R, G, B and Y, may be red, green, blue and yellow sub-pixel data.

The display apparatus 200 includes pixels, each including red, green, blue and yellow sub-pixels. Particularly, the data processing device 101 renders the image data, e.g., the red, green and blue image data R, G and B based on a layout of the sub-pixels. Accordingly, the display apparatus 200 may display the image using the rendered data, e.g., the red, green, blue and yellow image data R, G, B and Y.

Figure 13:
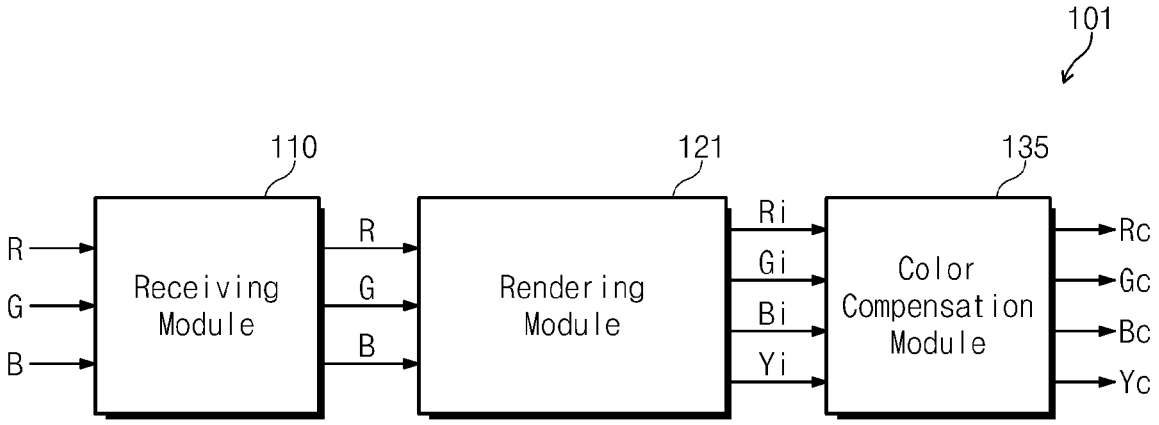
FIG. 13 is a block diagram of an exemplary embodiment of a data processing device of the display system of FIG. 12.
Figure 14:
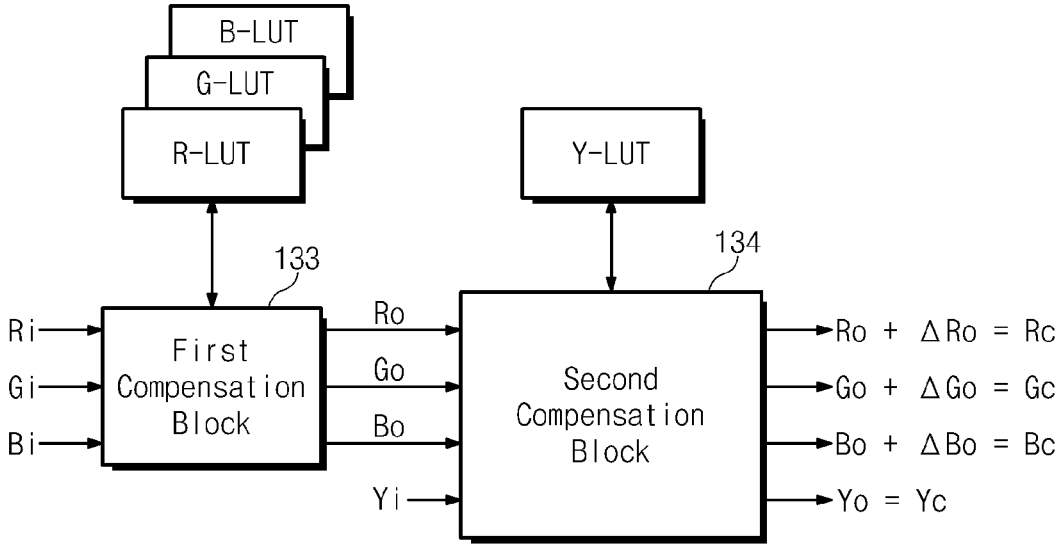
FIG. 14 is a block diagram of an exemplary embodiment of a color compensation module of FIG. 13.

FIG. 13 is a block diagram of an exemplary embodiment of a data processing device of the display system of FIG. 12. FIG. 14 is a block diagram of an exemplary embodiment of a color compensation module of FIG. 13.

As shown in FIG. 13, the data processing device 101 includes a receiving module 110, a rendering module 121 and a color compensation module 135.

The receiving module 110 receives the image data, e.g., the red, green and blue image data R, G and B, from the image source 10 shown in FIG. 12 and provides the image data R, G and B to the rendering module 121.

The rendering module 121 renders the image data, e.g., the red, green and blue image data R, G and B, received from the receiving module 110, to sub-pixel data, e.g., red, green, blue and yellow sub-pixel data Ri, Gi, Bi and Yi, based on the layout of the sub-pixels in the display apparatus 200. In an exemplary embodiment, when each of the pixels of the display apparatus 200 includes red, green, blue and yellow sub-pixels, the rendering module 121 renders the red, green and blue image data R, G and B to the red, green, blue and yellow sub-pixel data Ri, Gi, Bi and Yi.

The rendering process by the rendering module 121 may be similar to the rendering process shown in FIGS. 9 to 11C. However, the rendering process by the rendering module 121 related to the above exemplary embodiments will be omitted in order to avoid the redundancy.

The color compensation module 135 compensates for colors of the sub-pixel data, e.g., the red, green, blue and yellow sub-pixel data Ri, Gi, Bi and Yi, and outputs compensation data, e.g., red, green, blue and yellow compensation data Rc, Gc, Bc and Yc. Particularly, the color compensation module 135 gamma-compensates the sub-pixel data, e.g., the red, green, blue and yellow sub-pixel data Ri, Gi, Bi and Yi, based on a gamma compensation value set by a gamma characteristic of the display apparatus 200 and outputs the compensation data, e.g., the red, green, blue and yellow compensation data Rc, Gc, Bc and Yc. In an exemplary embodiment, the compensation data, e.g., the red, green, blue and yellow compensation data Rc, Gc, Bc and Yc, may have bit numbers expanded more than bit numbers of the sub-pixel data, e.g., the red, green, blue and yellow sub-pixel data Ri, Gi, Bi and Yi. Thus, the color compensation module 135 may effectively prevent a color coordinate value from varying depending on gray scales, and thereby improves color characteristics of the display apparatus 200.

As shown in FIG. 14, the color compensation module 135 includes a first compensation block 133 and a second compensation block 134.

The first compensation block 133 receives the red, green and blue sub-pixel data Ri, Gi and Bi and converts the red, green and blue sub-pixel data Ri, Gi and Bi into red, green and blue intermediate data Ro, Go and Bo, respectively, based on red, green and blue gamma compensation values set by red, green and blue gamma characteristics.

The red, green and blue sub-pixel data Ri, Gi and Bi provided to the first compensation block 133 may be the red, green and blue sub-pixel data Ri, Gi and Bi corresponding to the red, green and blue sub-pixels, respectively, included in a reference block determined with reference to the yellow sub-pixel. The reference block may be similarly determined to the reference block shown in FIGS. 6A to 8B.

The second compensation block 134 converts yellow sub-pixel data Yi corresponding to the yellow sub-pixel to yellow compensation data Yo based on a predetermined yellow gamma compensation value, e.g., Yo=Yi. In addition, the second compensation block 134 converts the red, green and blue intermediate data Ro, Go and Bo into red, green and blue compensation data Rc, Gc and Bc, respectively, based on the yellow sub-pixel data Yi.

In FIG. 1 to FIG. 14, the image data includes the white sub-pixel data Wi or the yellow sub-pixel data Yi. However, the image data may include magenta sub-pixel data or cyan sub-pixel data instead of the white and yellow sub-pixel data Wi and Yi.

Figure 15:
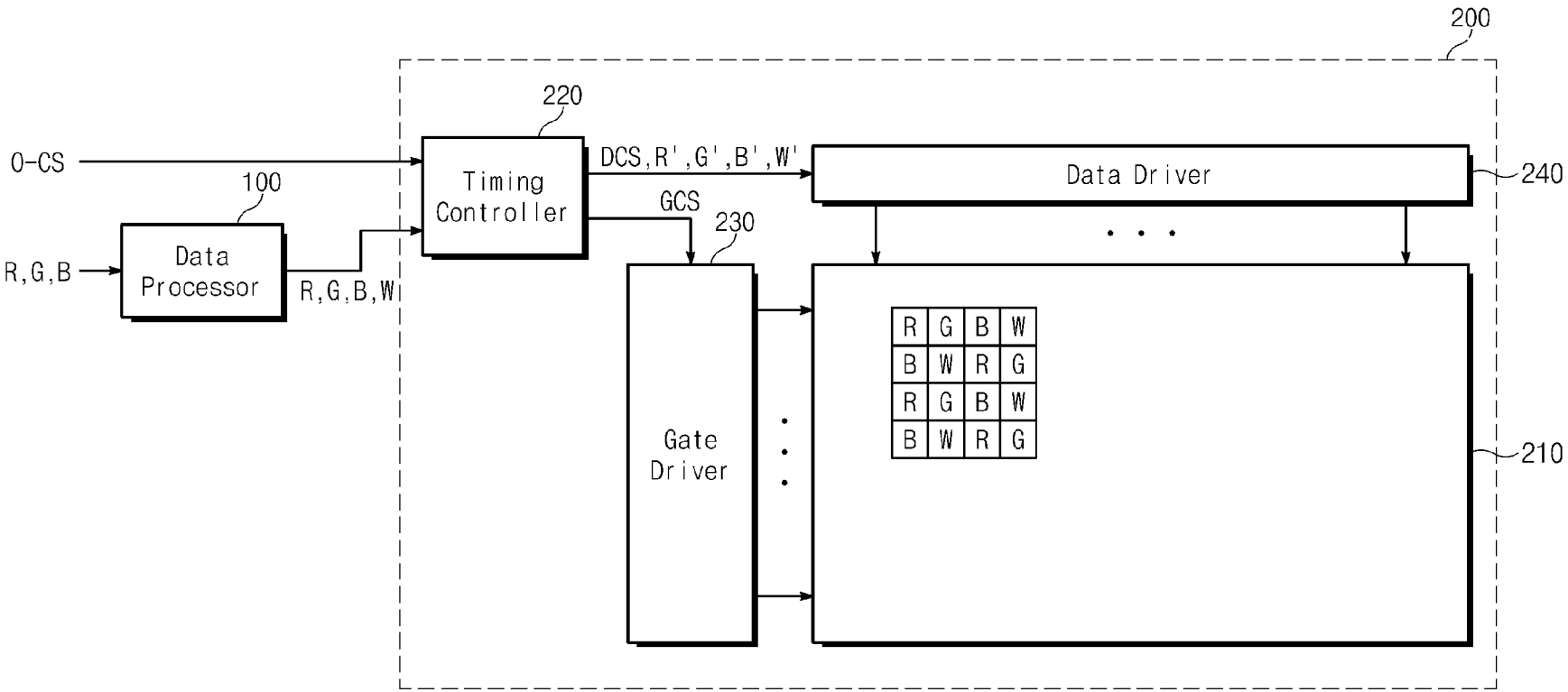
FIG. 15 is a block diagram showing an exemplary embodiment of a display apparatus of the display system FIG. 1.

FIG. 15 is a block diagram of an exemplary embodiment of a display apparatus of the display system of FIG. 1.

As shown in FIG. 15, a display apparatus 200 includes a display panel 210, a timing controller 220, a gate driver 230 and a data driver 240.

The display panel 210 displays an image and includes pixels disposed therein. Each of the pixels includes a PENTILE® pixel structure and thus includes four sub-pixels, e.g., red, green, blue and white sub-pixels R, G, B and W. In another exemplary embodiment, the each of the pixels may include a yellow sub-pixel instead of the white sub-pixel. When the display apparatus displays the image using the display panel 210 including the PENTILE® pixel structure, the data processing device 100, e.g., a data processor 100, provides rendered data to the timing controller 220. In an exemplary embodiment, as described above, the data processing device 100 may compensate for colors of the rendered data using the color compensation module 130 of FIG. 2 and provide compensated data to the timing controller 220. Although not shown in FIG. 15, as another exemplary embodiment, the color compensation module 130 may included in the timing controller 220 or in the display apparatus 200.

The timing controller 220 receives the rendered data, e.g., rendered red, green, blue and white sub-pixel data R, G, B and W, from the data processing device 100 and converts the rendered red, green, blue and white sub-pixel data R, G, B and W into a predetermined data format and provides converted red, green, blue and white sub-pixel data R', G', B' and W' to the data driver 240. In an exemplary embodiment, the timing controller 220 receives various control signals O-CS and converts the control signals O-CS into a data control signal DCS and a gate control signal GCS and provides the data control signal DCS and the gate control signal GCS to the gate driver 230 and the data driver 240, respectively.

The data driver 240 converts the converted red, green, blue and white sub-pixel data R', G', B' and W' to data voltages in response to the data control signal DCS and provides the data voltages to the display panel 210, and the gate driver 230 outputs a gate signal in a predetermined order to drive the pixels in a row by row manner.

Accordingly, the display apparatus 200 according to the exemplary embodiments described herein includes the PENTILE® pixel structure and displays an image having substantially improved brightness and, accordingly, accurately displays colors of the image.

The present invention should not be construed as being limited to the exemplary embodiment set forth herein. Rather, these exemplary embodiments are provided so that this disclosure will be thorough and complete and will fully convey the concept of the present invention to those skilled in the art.

While the present invention has been particularly shown and described with reference to the exemplary embodiments thereof, it will be understood by those of ordinary skill in the art that various changes in form and details may be made therein without departing from the spirit or scope of the present invention as defined by the following claims.

What is claimed is:

1. A data processing device for processing image data and providing the image data to a display apparatus including pixels, each including a first sub-pixel, a second sub-pixel, a third sub-pixel and a fourth sub-pixel which have different colors from each other, the data processing device comprising:

a receiving module which receives the image data;

a rendering module which renders the image data into first sub-pixel data, second sub-pixel data, third sub-pixel data and fourth sub-pixel data based on a layout of the first sub-pixel, the second sub-pixel, the third sub-pixel and the fourth sub-pixel;

a color compensation module which compensates for a color of the first sub-pixel data, the second sub-pixel data, the third sub-pixel data and the fourth sub-pixel data;

a plurality of first look-up tables which only stores first intermediate data corresponding to the first sub-pixel data, second intermediate data corresponding to the second sub-pixel data and third intermediate data corresponding to the third sub-pixel data therein, respectively, and a second look-up table which stores the fourth sub-pixel data, a fourth compensation data, a first delta value, a second delta value and a third delta value therein, wherein the color compensation module comprises:

a first compensation block which only converts the first sub-pixel data, the second sub-pixel data and the third sub-pixel data corresponding to the first sub-pixel, the second sub-pixel and the third sub-pixel, respectively, included in a reference block set based on the fourth sub-pixel, into the first intermediate data, the second intermediate data and the third intermediate data, respectively, based on the plurality of first look-up tables; and a second compensation block which converts the fourth sub-pixel data directly received from the rendering module, corresponding to the fourth sub-pixel, into the fourth compensation data based on the second look-up table, and converts the first intermediate data, the second intermediate data and the third intermediate data into first compensation data, second compensation data and third compensation data based on the first delta value, the second delta value and the third delta value, respectively, which are determined based on the fourth sub-pixel data.

2. The data processing device of claim 1, wherein the second compensation block generates the first compensation data, the second compensation data and the third compensation data by adding the first delta value, the second delta value and the third delta value to the first intermediate data, the second intermediate data and the third intermediate data, respectively.

3. The data processing device of claim 2, wherein the first sub-pixel has a red color, the second sub-pixel has a green color and the third sub-pixel has a blue color, the first delta value is one of zero and a positive constant number, and each of the second delta value and the third delta value is one of zero or a negative constant value.

4. The data processing device of claim 1, wherein the reference block includes at least one of the first sub-pixels, at least one of the second sub-pixels and at least one of the third sub-pixels, the second compensation block generates a first result value by dividing the first delta value by the number of the one first sub-pixels in the reference block and generates the first compensation data by adding the first result value to first intermediate data of each of the at least one of the first sub-pixel, the second compensation block generates a second result value by dividing the second delta value by the number of the second sub-pixels in the reference block and generates the second compensation data by adding the second result value to second intermediate data of each of the at least one of the second sub-pixel, and the second compensation block generates a third result value by dividing the third delta value by the number of the third sub-pixels in the reference block and generates the third compensation data by adding the third result value to third intermediate data of each of the at least one of the third sub-pixel.

5. The data processing device of claim 1, wherein the reference block is defined as one pixel of the pixels in which the fourth sub-pixel is included, and the second compensation block adds the first delta value, the second delta value and the third delta value to the first intermediate data, the second intermediate data and the third intermediate data, respectively, corresponding to the first sub-pixel, the second sub-pixel and the third sub-pixel, respectively, included in the one pixel.

6. The data processing device of claim 1, wherein the reference block comprises four sub-pixels disposed adjacent to four sides of the fourth sub-pixel, and the fourth sub-pixel represents one of white, yellow, magenta, or cyan colors.

7. The data processing device of claim 6, wherein the four sub-pixels comprise a blue sub-pixel disposed adjacent to a first side of the fourth sub-pixel, a red sub-pixel disposed adjacent to a second side opposite to the first side, a first green sub-pixel disposed adjacent to a third side of the fourth sub-pixel, and a second green sub-pixel disposed adjacent to a fourth side opposite to the third side.

8. The data processing device of claim 7, wherein the second compensation block adds the first delta value to red intermediate data corresponding to the red sub-pixel, adds the third delta value to blue intermediate data corresponding to the blue sub-pixel, and adds a value acquired by dividing the second delta value by two to each of first green intermediate data and second green intermediate data corresponding to the first green sub-pixel and the second green sub-pixel, respectively.

9. The data processing device of claim 1, wherein the reference block comprises eight sub-pixels disposed adjacent to the fourth sub-pixel, and the fourth sub-pixel represents one of white, yellow, magenta, or cyan colors.

10. The data processing device of claim 9, wherein the eight sub-pixels comprise a first red sub-pixel, a second red sub-pixel and a third red sub-pixel, a first blue sub-pixel, a second blue sub-pixel, a third blue sub-pixel, a first green sub-pixel and a second green sub-pixel.

11. The data processing device of claim 10, wherein the second compensation block adds a value acquired by dividing the first delta value by three to each of first red intermediate data, second red intermediate data and third red intermediate data, respectively, corresponding to the first red sub-pixel, the second red sub-pixel and the third red sub-pixel, adds a value acquired by dividing the third delta value by three to each of first blue intermediate data, second blue intermediate data and third blue intermediate data, respectively, corresponding to the first blue sub-pixel, the second blue sub-pixel and the third blue sub-pixel, and adds a value acquired by dividing the second delta value by two to each of first green intermediate data and second green intermediate data, respectively, corresponding to the first green sub-pixel and the second green sub-pixel, respectively.

12. The data processing device of claim 1, wherein the image data comprises first image data, second image data and third image data, and the rendering module comprises:

a mapping part which maps the first image data, the second image data and the third image data to first data, second data, third data and fourth data; and a rendering part which outputs the first sub-pixel data, the second sub-pixel data, the third sub-pixel data and the fourth sub-pixel data generated by rendering the first data, the second data, the third data and the fourth data passed through a rendering filter.

13. The data processing device of claim 12, wherein the rendering module further comprises:

an input gamma control part which linearizes a gray scale value of the first image data, the second image data and the third image data by controlling a gamma of the image data; and an output gamma control part which non-linearizes the first sub-pixel data, the second sub-pixel data, the third sub-pixel data and the fourth sub-pixel data outputted from the rendering part.

14. The data processing device of claim 13, wherein the color compensation module is disposed between the rendering part and the output gamma control part.

15. A display system comprising:

an image source which outputs image data;

a display apparatus which includes pixels and displays an image, each of the pixels including a first sub-pixel, a second sub-pixel, a third sub-pixel and a fourth sub-pixel which have different colors from each other; and a data processing device which processes the image data and provides processed image data to the display apparatus, wherein the data processing device comprises:

a receiving module which receives the image data from the image source;

a rendering module which renders the image data into first sub-pixel data, second sub-pixel data, third sub-pixel data and fourth sub-pixel data based on a layout of the first sub-pixel, the second sub-pixel, the third sub-pixel and the fourth sub-pixel;

a color compensation module which compensates for a color of the first sub-pixel data, the second sub-pixel data, the third sub-pixel data and the fourth sub-pixel data;

a plurality of first look-up tables which only stores first intermediate data corresponding to the first sub-pixel data, second intermediate data corresponding to the second sub-pixel data and third intermediate data corresponding to the third sub-pixel data therein, respectively, and a second look-up table which stores the fourth sub-pixel data, a fourth compensation data, a first delta value, a second delta value and a third delta value therein, wherein the color compensation module comprises:

a first compensation block which converts the first sub-pixel data, the second sub-pixel data and the third sub-pixel data corresponding to the first sub-pixel, the second sub-pixel and the third sub-pixel, respectively, included in a reference block set based on the fourth sub-pixel, into the first intermediate data, the second intermediate data and third intermediate data, respectively, based on the plurality of first look-up tables; and a second compensation block which converts the fourth sub-pixel data directly received from the rendering module, corresponding to the fourth sub-pixel, into the fourth compensation data, based on the second look-up table, and converts the first intermediate data, the second intermediate data and the third intermediate data into first compensation data, second compensation data and third compensation data, respectively, based on the first delta value, the second delta value and the third delta value which are determined based on the fourth sub-pixel data.

16. The display system of claim 15, wherein the reference block is defined as one pixel of the pixels in which the fourth sub-pixel is included, and the second compensation block adds the first delta value, the second delta value and the third delta value to the first intermediate data, the second intermediate data and the third intermediate data, respectively, corresponding to the first sub-pixel, the second sub-pixel and the third sub-pixel, respectively, included in the one pixel.

17. The display system of claim 15, wherein the fourth sub-pixel represents one of white, yellow, magenta, or cyan colors, and the first sub-pixel, the second sub-pixel, and the third sub-pixel have a red color, a green color and a blue color, respectively.

18. A method of processing image data provided to a display apparatus including pixels, each including a first sub-pixel, a second sub-pixel, a third sub-pixel and a fourth sub-pixel, which have different colors from each other, the method comprising:

receiving the image data;

rendering the image data into first sub-pixel data, second sub-pixel data, third sub-pixel data and fourth sub-pixel data, by a rendering module, based on a layout of the first sub-pixel, the second sub-pixel, the third sub-pixel and the fourth sub-pixel;

compensating for a color of the first sub-pixel data, the second sub-pixel data, the third sub-pixel data and the fourth sub-pixel data;

storing only first intermediate data corresponding to the first sub-pixel data, second intermediate data corresponding to the second sub-pixel data and third intermediate data corresponding to the third sub-pixel data in a plurality of first look-up tables, respectively, storing the fourth sub-pixel data a fourth compensation data, a first delta value, a second delta value and a third delta value in a second look-up table, wherein the compensating for the color comprises:

converting only the first sub-pixel data, the second sub-pixel data and the third sub-pixel data, by a first compensation block, corresponding to the first sub-pixel, the second sub-pixel and the third sub-pixel, respectively, included in a reference block set based on the fourth sub-pixel into the first intermediate data, the second intermediate data and the third intermediate data, respectively, based on the plurality of first look-up tables;

converting the fourth sub-pixel data directly from the rendering module, by a second compensation block, corresponding to the fourth sub-pixel into the fourth compensation data based on the second look-up table; and converting the first intermediate data, the second intermediate data and the third intermediate data into first compensation data, second compensation data and third compensation data, respectively, by the second compensation block, based on the first delta value, the second delta value and the third delta value, respectively, which are determined based on the fourth sub-pixel data of the second look-up table.

19. The method of claim 18, wherein the reference block is defined as one pixel of the pixels in which the fourth sub-pixel is included, and the first compensation data, the second compensation data and the third compensation data are generated by adding the first delta value, the second delta value and the third delta value to the first intermediate data, the second intermediate data and the third intermediate data, respectively, corresponding to the first sub-pixel, the second sub-pixel and the third sub-pixel, respectively, included in the one pixel.

20. The method of claim 18, wherein the fourth sub-pixel represents one of white, yellow, magenta, or cyan colors, and the first sub-pixel, the second sub-pixel, and the third sub-pixel have a red color, a green color and a blue color, respectively.

* * * * *